US006557711B2

(12) United States Patent
Grueneberg

(10) Patent No.: US 6,557,711 B2
(45) Date of Patent: May 6, 2003

(54) SHELF EXTENDER DISPLAY UNIT

(75) Inventor: Bevan E. Grueneberg, Cedarburg, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 10/112,397

(22) Filed: Mar. 28, 2002

(65) Prior Publication Data

US 2002/0139808 A1 Oct. 3, 2002

Related U.S. Application Data

(60) Provisional application No. 60/280,219, filed on Mar. 30, 2001.

(51) Int. Cl.[7] ..... A47G 29/087

(52) U.S. Cl. ..... 211/119.003; 211/90.01; 211/90.02; 211/86.01; 211/134; 211/88.01

(58) Field of Search ..... 211/119.003, 90.01, 211/90.02, 86.01, 134, 88.01

(56) References Cited

U.S. PATENT DOCUMENTS 3,193,108 A * 7/1965 Johnson
3,289,615 A * 12/1966 Marschak
3,494,479 A * 2/1970 Martin
3,567,038 A * 3/1971 Ammann ..... 211/88.01
3,647,078 A * 3/1972 Fortunato ..... 211/88.01 X
3,744,645 A * 7/1973 Hochman
3,752,323 A * 8/1973 Kayden
3,776,388 A * 12/1973 Mattheis ..... 211/86.01
3,949,880 A * 4/1976 Fortunato ..... 211/86.01
4,201,291 A * 5/1980 Davidson
4,687,094 A * 8/1987 Allsop et al. ..... 211/88.01 X

OTHER PUBLICATIONS

Applicant's Exhibit A: Sketch showing prior art shelf extenders; admitted prior art.

* cited by examiner

*Primary Examiner*—Robert W. Gibson, Jr.
(74) *Attorney, Agent, or Firm*—Quarles & Brady LLP

(57) ABSTRACT

A shelf attachment display unit includes a tray, a hanger bracket and a placard each made from a blank of corrugated cardboard. The tray blank is folded to form front, back, bottom and end walls and the back wall has a pair of vertical slots therein. The hanger bracket is folded to form a brace extending laterally behind the back wall and having arms at its ends. The arms define channels opening in the direction of the brace and tabs extending away from the brace having upwardly opening notches for engagement with the slots in the back wall of the tray. The channels are sized to receive an edge of a shelf member and the brace is positioned to contact an underside of the shelf member when the shelf member is in the channels so as to cantilever the shelf display unit to the shelf.

16 Claims, 2 Drawing Sheets

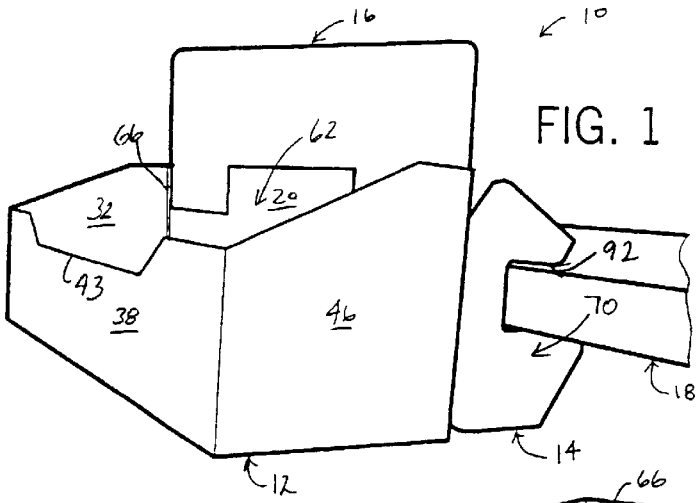
FIG. 1
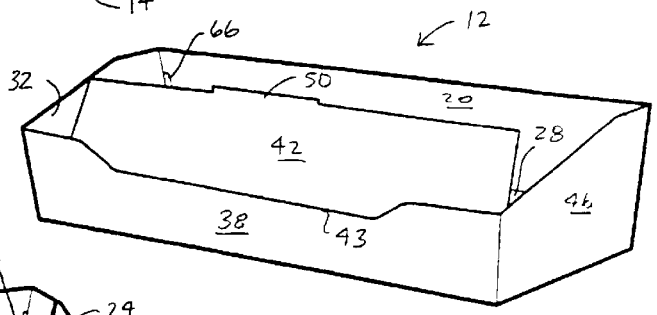
FIG. 3
FIG. 4
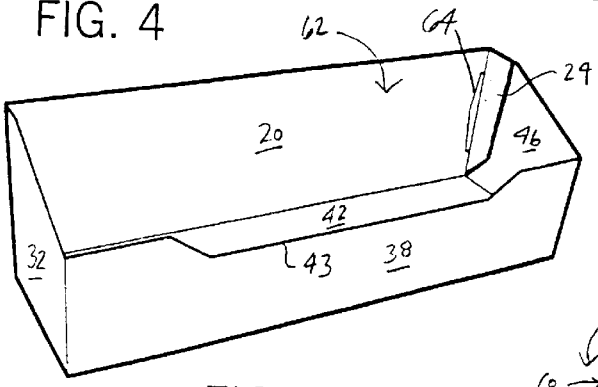
FIG. 7
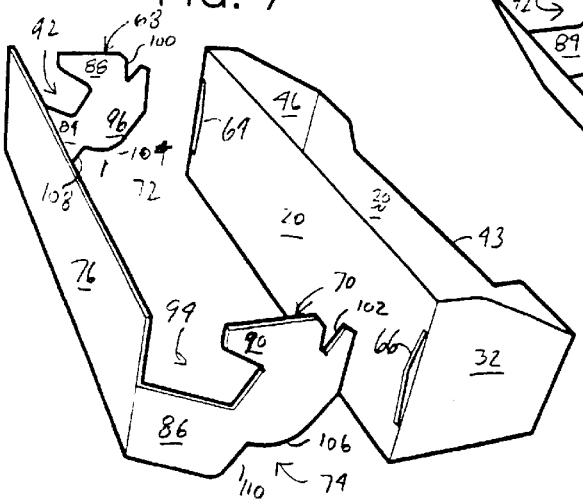
FIG. 8
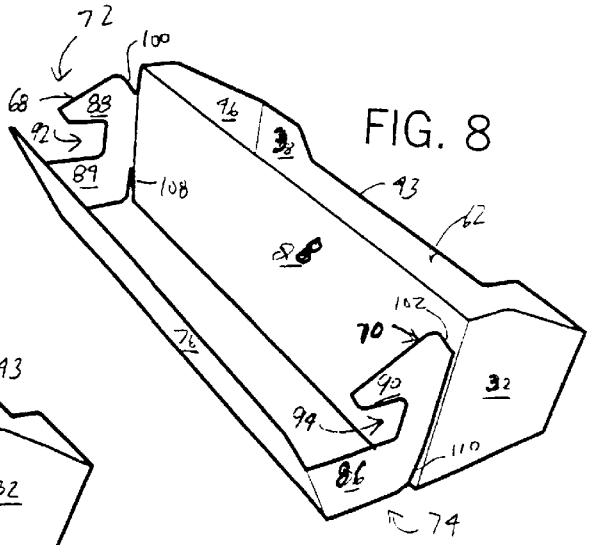

SHELF EXTENDER DISPLAY UNIT

CROSS-REFERENCE TO RELATED APPLICATIONS

This claims the benefit of U.S. Provisional Patent Application No. 60/280,219 filed Mar. 30, 2001.

STATEMENT REGARDING FEDERALLY SPONSORED RESEARCH/DEVELOPMENT

Not Applicable.

BACKGROUND OF THE INVENTION

This invention relates to product displays and in particular to display units for augmenting the shelf space of product display areas.

Conventional practice in retail stores is to display products for sale on racks and shelves. Shelf space is limited and therefore costly. Retailers tend to stock the items tightly on the shelf to maximize shelf space. It is also common to augment the shelf space by adding end cap displays or other free standing display units next to the area where similar products are displayed on the shelving. This is a common practice for displaying promotional items. One problem with such displays is that they occupy floor space, which makes the aisles more difficult to maneuver. Moreover, the displays are often made to be disposable or for temporary use and as such they are often unstable and can be tipped over easily.

Another technique to augment shelf space is to display items in counter top displays at or near check out areas of the store. Such displays are generally only used for small items and they can clutter the counter tops and interfere with the check out process.

Yet another technique to increase product display space is to mount bins or trays to the front of the shelves. The trays can be adhered to the front edge of the shelf. However, over time the adhesive can weaken so that the tray no longer properly mounts to the shelf. Or, if the display is intended to be used only temporarily, after the display is removed, residual adhesive remains on the shelf, which can be messy and unsightly unless removed. It is also known to suspend the tray from the front of the shelf using suitable hanger brackets. For example, it is known to include slots in a rear upright wall of the tray in which fit a hanger at each end that cantilevers to the shelf. A problem with these type of display units is that the tray can be disengaged from the shelf by the hangers separating from the tray or shelf. For example, some hangers only engage the tray in a friction fit such that the tray can be inadvertently pulled away from the hangers. The hangers could be permanently fixed to the tray using an adhesive or other fastener, however, then the display cannot be easily disassembled. The hangers also have been susceptible to sagging and accidental disengagement from the shelf.

Accordingly, there is a need in the art for an improved display unit.

SUMMARY OF THE INVENTION

The present invention provides a shelf attachment display unit having a tray and a hanger bracket. The tray is folded from a first blank to form front and back walls joined at their ends by end walls and at their bottoms by a bottom wall. The hanger bracket is folded from a second blank to form a brace extending laterally behind the back wall and having arms folded generally perpendicular at its ends. The arms define channels opening upwardly adjacent to the brace and tabs extending forwardly from the brace for supportively engaging the tray. The channels are sized to receive an edge of a shelf member and the brace is positioned to contact an underside of the shelf member when the shelf member is in the channels.

Preferably, the shelf display unit includes a placard having slots along a bottom side that allow it to be mounted to a top edge of the back wall of the tray. The surface of the placard, as well as the tray and the hanger bracket, can include words, graphics or other indicia by printing or applying suitable labels thereon.

The invention also provides a kit of the blanks from which the shelf display unit is folded. The kit includes a tray blank and a hanger bracket blank, which are preferably made of corrugated cardboard so that the blanks can be folded into the tray and hanger brackets described herein.

Specifically, the tray blank has a lateral fold line extending from a first end to a second end of the tray blank. At the first end, the tray blank defines an end flap along a first longitudinal fold line adjacent a first edge of a rectangular back panel, which has a bottom side along the lateral fold line adjacent a bottom flap and has a second edge opposite the first edge along a second longitudinal fold line adjacent a first edge of a first end wall. The first end wall has a bottom edge along the lateral fold line adjacent a first corner flap and a second edge opposite the first edge along a third longitudinal fold line adjacent a first edge of a front panel. The front panel has a bottom edge along the lateral axis adjacent a bottom wall extending longitudinally approximately the lateral dimension between the second and third longitudinal fold lines. The front wall has a second edge spaced from the first edge the lateral distance between the first and second longitudinal fold lines and extending along a fourth longitudinal axis adjacent a second end wall, which has a bottom edge along the lateral axis adjacent a second corner flap.

The hanger bracket blank defines a lateral brace panel having a first end and a second end along respective first end and second end longitudinal fold lines adjacent first and second arms. The arms each define an extension oblique to the brace panel and a hook end defining a channel opening toward the brace panel and a tab extending away from the brace panel and including an upwardly opening notch. The back panel of the tray blank includes longitudinal slots each sized to receive an arm tab. Preferably, the bottom panel of the tray blank has a lateral tab extending longitudinally along a bottom edge and the back panel has a lateral slot along the lateral folding line sized to receive the bottom panel tab. The kit can also include a placard blank having a bottom side extending laterally the distance between the first and second fold lines of the tray blank and having slots opening to the bottom side.

The shelf display unit can be disassembled by pulling the placard from the back wall of the tray and disengaging the tabs of the hanger bracket arms from the slots in the back wall of the tray. The hanger bracket can be collapsed by folding the arms inwardly. The tray can be collapsed by disengaging an edgewise tab of the bottom wall from a lateral slot in the back wall and pivoting it upward so that one end wall can be moved toward the front wall and the opposite end wall can be moved toward the back wall.

The invention thus provides a low cost display unit that can extend the display space of shelving units without cluttering counter tops or floor space. The display unit can be shipped and stored in a compact package and easily assembled. Once assembled, the unit can be quickly mounted for display by hooking the hanger bracket arms about a front part of a conventional shelf. The hanger bracket cantilevers the tray to the shelf and contacts the top and the underside of the shelf such that the weight of contents in the tray increases the grip of the hanger bracket on the shelf.

The foregoing and other objects and advantages of the present invention will appear from the following description. In the description, reference is made to the accompanying drawings which form a part hereof and in which there is shown by way of illustration a preferred embodiment of the invention. Such an embodiment does not necessarily represent the full scope of the invention, however, and reference must be made therefore to the claims for interpreting the scope of the invention.

BRIEF DESCRIPTION OF THE DRAWINGS

FIG. 1 is a perspective view of the shelf extender display of the present invention;

FIG. 3 is a front perspective view of the tray partially folded;

FIG. 4 is a front perspective view of the tray;

FIG. 7 is a back perspective view of the hanger bracket prior to assembly to the tray;

FIG. 8 is a back perspective view of a hanger bracket assembled to the tray.

DETAILED DESCRIPTION OF THE PREFERRED EMBODIMENT

Figure 9:
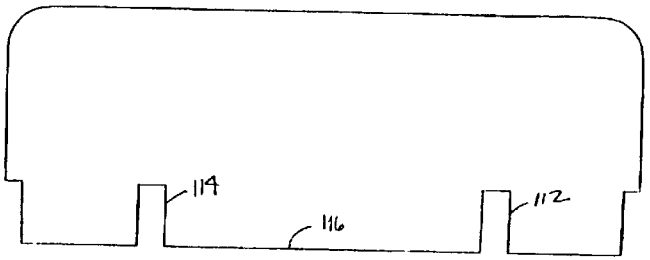
FIG. 9 is a plan view of the placard component of the shelf extender display of FIG. 1.

Referring to FIG. 1, the shelf extender display unit 10 of the present invention includes three components, namely, a tray 12, a hanger bracket 14 and a placard 16. The tray 12 defines a storage volume for holding items, such as retail products and promotional items for display at the point of purchase. The tray 12 is cantilevered to the front edge of horizontal shelf 18 of conventional retail product shelving. The placard 16 is removably attached to a back wall 20 of the tray 12 in a tongue and groove type connection. The placard 16 can have labels, printed messages or other indicia related to the items in or near the tray 12.

Figure 2:
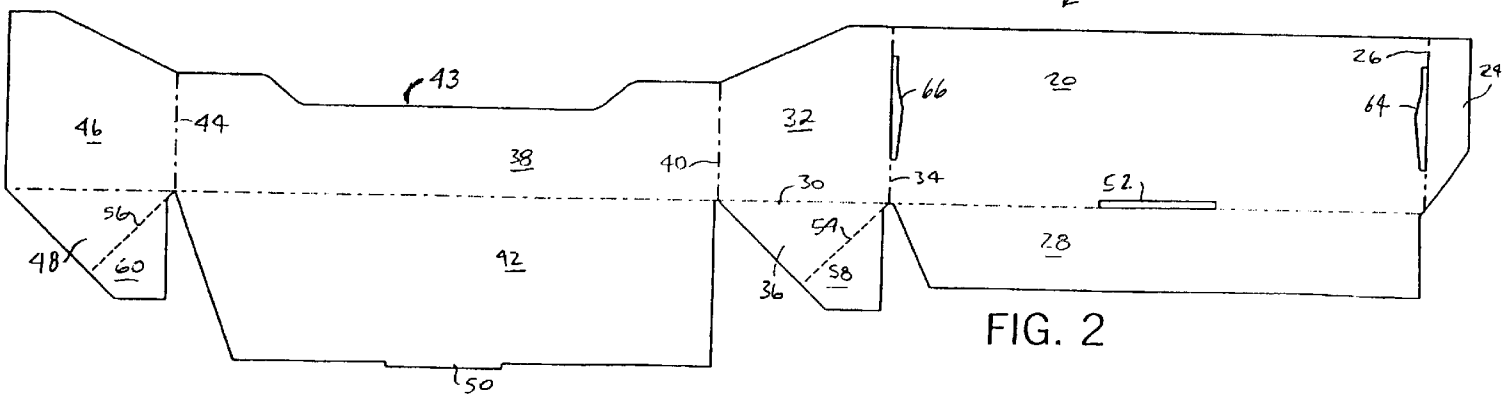
FIG. 2 is a plan view of the blank forming the tray component of the shelf extender display of FIG. 1 prior to folding.

Referring now to FIG. 2, tray 12 is formed from a flat blank 22, preferably made of corrugated cardboard. Specifically, FIG. 2 is oriented so that the top, bottom, left and right sides of the figure correspond to the respective sides of the tray 12 when viewed from a position in front of the shelf.

Working from right to left in FIG. 2, the blank 22 includes an end flap 24 adjacent a right end of the back wall 20 along fold line 26. A bottom flap 28 lies adjacent a bottom side of the back wall 20 along lateral fold line 30. A back edge of left end wall 32 is adjacent the left end of the back wall 20 along fold line 34. The bottom edge of the left end wall 32 joins left rear corner flap 36 along fold line 30 and the top edge angles downward from back to front. The front edge of the left end wall 32 connects to a front wall 38 along fold line 40. The upper edge of the front wall 38 defines a recess 43 in the center. The bottom edge of the front wall 38 is connected to a bottom wall 42 along the fold line 30. The front wall 38 is connected at its left edge along fold line 44 to right end wall 46. The right end wall 46 is identical to the left end wall 32 with a downwardly sloping upper edge. The right end wall 46 is connected to a right front corner flap 48 at its bottom edge along the fold line 30.

Figure 5:
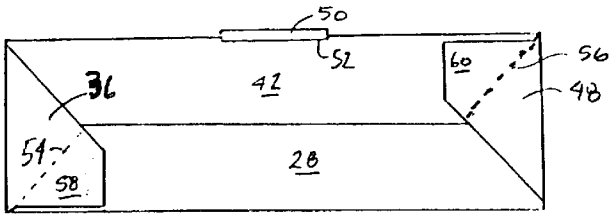
FIG. 5 is a bottom view of the tray.

Referring to FIGS. 2, 3 and 4, the tray 12 is formed by folding the blank 22 along the parallel, vertical fold lines 34 and 40 in a clockwise direction so that the front wall 38 is parallel to and in front of the back wall 20. The right end flap 24 is folded in a counter clockwise direction about fold line 26 to be generally perpendicular to the back wall 20 and the right end wall 46 is folded clockwise about fold line 44 to be perpendicular to the front wall 48 and outside the end flap 24. An adhesive is applied between the end flap 24 and the right end wall 46 to secure them together. The adhesive is shown in FIG. 4 for illustration purposes only, it is not visible after assembly. The bottom wall 42 is then folded up along fold line 30 approximately 90 degrees so that a tab 50 can fit into a horizontal slot 52 adjacent fold line 30 at the center of the back wall 20. The bottom flap 28 is then folded up along fold line 30 approximately 90 degrees so that it lies adjacent to (but beneath) the bottom wall 20. The left rear 36 and right front 48 corner flaps are then folded inwardly approximately 90 degrees along fold line 30. Referring to FIGS. 2 and 5, the corner flaps 36 and 48 include fold lines 54 and 56 substantially bisecting the flaps 36 and 48 to define segments 58 and 60, respectively. With the corner flaps 36 and 48 folded up beneath the bottom wall 42 and the bottom flap 28, adhesive can be applied between segment 58 and the bottom wall 42 as well as between segment 60 and the bottom flap 28. Again, the adhesive is shown in FIG. 5 for illustration purposes only. The tray 12 thus defines an upwardly opening cavity 62, as shown in FIG. 4.

Figure 6:
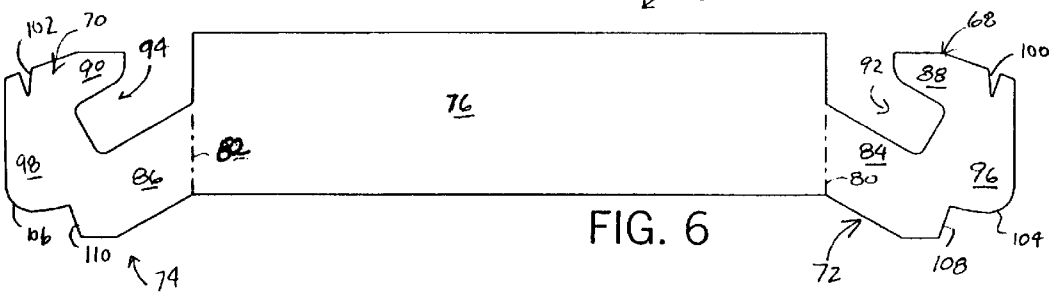
FIG. 6 is plan view of the blank forming the hanger bracket component of the shelf extender display of FIG. 1 prior to folding.

The back wall 20 of the tray 12 includes two vertical slots 64 and 66 adjacent fold lines 26 and 34. The slots 64 and 66 widen near their middles to ease insertion therein of hook ends 68 and 70 of arms 72 and 74 on each end of a brace 76 defining the hanger bracket 14. As shown in FIG. 6, the hanger bracket 14 is formed of a flat, preferably corrugated cardboard, blank 78. The blank 78 has two vertical fold lines 80 and 82 between the brace 76 and the arms 72 and 74, respectively. The hanger bracket 14 is formed by simply pivoting the arms 72 and 74 inwardly along the respective fold lines 80 and 82 about 90 degrees so that they are perpendicular to the brace 76, as shown in FIG. 7.

The arms 72 and 74 are identical and have extensions 84 and 86 angling downwardly from the brace 76 to the hook ends 68 and 70. The hook ends 68 and 70 have bent fingers 88 and 90 at the upper end that (in cooperation with the extensions 84 and 86) define channels 92 and 94 for receiving the front edge of the shelf 18. The hook ends 68 and 70 also define tabs 96 and 98 having notches 100 and 102 at the upper end and rounded lower ends 104 and 106 extending to angled stop surfaces 108 and 110, respectively. The tabs 96 and 98 are sized to easily fit into the slots 64 and 66 in the back wall 20 of the tray 12 so that the top of the slots 64 and 66 rest in the bottom of the notches 100 and 102, respectively, as shown in FIG. 8.

The shelf extender display 10 is mounted to the shelf 18 by tipping the unit down so that the front edge of the shelf 18 can fit between the brace 76 and the fingers 88 and 90 of the arms 72 and 74 and into the channels 92 and 94. The unit can then be lowered so that the top edge of the brace 76 contacts the underside of the shelf 18 and the underside of the fingers 88 and 90 contact the top of the shelf 18. Due to the angle of the brace 76 and the arms 72 and 74, the unit is cantilevered to the shelf 18 slightly tipped backward. This allows the unit to be level after deflecting due to the weight of the contents of the tray 12.

Referring to FIGS. 1 and 9, the placard 16 is a flat planar blank, preferably corrugated cardboard, with two vertical slots 112 and 114 extending up from a bottom edge 116 so that the placard 16 can be attached to a back wall 20 of the tray 12 by inserting the back wall 20 into the slots 112 and 114. The bottom corners of the placard 16 are notched so that overlapping portion can fit between the end walls 32 and 46.

The shelf extender display unit 10 can be collapsed for compact storage or shipping. This is done by first disassembling the unit, that is pulling the placard 16 up away from the tray 12 and disengaging the hook ends 68 and 70 of the arms 72 and 74 from the slots 64 and 66 in the back wall 20 of the tray 12. The arms 72 and 74 can then be folded inwardly along fold lines 80 and 82. The tray 12 can be collapsed by bowing the middle of the back wall 20 slightly outward so that the tab 50 can be disengaged from slot 52 and the bottom wall 42 and the bottom flap 28 can be pivoted upwardly. Then, the tray 12 can be flattened by bringing the front wall 38 toward the back wall 20.

A preferred embodiment of the invention has been described in detail for the purpose of disclosing a practical, operative structure whereby the invention may be practiced advantageously. The design described is intended to be illustrative only. The novel characteristics of the invention may be incorporated in other structural forms without departing from the scope of the invention.

I claim:

1. A shelf attachment display unit, comprising:

a tray folded from a first material blank to have a front wall and a back wall joined at their ends by end walls and at their bottoms by a bottom wall; and a hanger bracket folded from a second material blank to have a brace extending laterally behind the back wall and having arms folded generally perpendicular at its ends defining channels opening upwardly adjacent to the brace and tabs extending forwardly from the brace for supportively engaging the tray;

wherein the channels are sized to receive an edge of a shelf member and the brace is positioned to have its top edge contact an underside of the shelf member when the shelf member is in the channels.

2. The shelf attachment display unit of claim 1, wherein the tabs have rounded lower edges.

3. The shelf attachment display unit of claim 2, wherein the arms also include flat stop surfaces adjacent the lower end of the tabs for mating with the back wall.

4. The shelf attachment display unit of claim 1, wherein the first and second blanks are corrugated cardboard.

5. The shelf attachment display unit of claim 1, further including a placard extending substantially parallel to the back wall mounted to a top portion of the back wall.

6. The shelf attachment display unit of claim 5, wherein the placard is corrugated cardboard.

7. The shelf attachment display unit of claim 1, wherein the bottom wall includes a lateral tab engaging a lateral slot in the bottom of the back wall.

8. The shelf attachment display unit of claim 7, wherein the tray can be collapsed when the bottom wall tab is disengaged from the back wall slot.

9. The shelf attachment display unit of claim 8, wherein the tray is collapsed by bringing one end wall toward the front wall and the opposite end wall toward the back wall.

10. The shelf attachment display unit of claim 1, wherein the arms extend obliquely to the brace.

11. The shelf attachment display unit of claim 1, wherein the back wall of the tray has upright slots that engage upwardly opening notches of the arms of the hanger bracket.

12. The shelf attachment display unit of claim 11, wherein each slot is wider in the middle than at its top end.

13. A shelf extender display unit blank kit, comprising:

a tray blank having a lateral fold line extending from a first end to a second end of the tray blank, at the first end the tray blank defining an end flap along a first longitudinal fold line adjacent a first edge of a rectangular back panel having a bottom side along the lateral fold line adjacent a bottom flap and having a second edge opposite the first edge along a second longitudinal fold line adjacent a first edge of a first end wall having a bottom edge along the lateral fold line adjacent a first corner flap and a second edge opposite the first edge along a third longitudinal fold line adjacent a first edge of a front panel having a bottom edge along the lateral axis adjacent a bottom wall extending longitudinally approximately the lateral dimension between the second and third longitudinal fold lines, the front wall having a second edge spaced from the first edge the lateral distance between the first and second longitudinal fold lines and extending along a fourth longitudinal axis adjacent a second end wall having a bottom edge along the lateral axis adjacent a second corner flap;

a hanger bracket blank defining a lateral brace panel having a first end and a second end along respective first end and second end longitudinal fold lines adjacent first and second arms each defining an extension oblique to the brace panel and a hook end defining a channel opening toward the brace panel and a tab extending away from the brace panel and including an upwardly opening notch;

wherein the back panel includes longitudinal slots each sized to receive an arm tab.

14. The kit of claim 12, wherein the bottom panel includes a lateral tab extending longitudinally along a bottom edge and wherein the back panel includes a lateral slot along the lateral folding line sized to receive the bottom panel tab.

15. The kit of claim 14, further including a placard blank having a bottom side extending laterally the distance between the first and second fold lines of the tray blank and having slots opening to the bottom side.

16. The kit of claim 13, wherein the tray blank, the hanger bracket blank and the placard blank are corrugated cardboard.

* * * * *